US006575423B2

(12) United States Patent
Erwin

(10) Patent No.: US 6,575,423 B2
(45) Date of Patent: Jun. 10, 2003

(54) MAILBOX POST ASSEMBLY

(75) Inventor: Ronald D. Erwin, Fayetteville, GA (US)

(73) Assignee: Erwin Industries, Inc., Peachtree City, GA (US)

( * ) Notice: Subject to any disclaimer, the term of this patent is extended or adjusted under 35 U.S.C. 154(b) by 0 days.

(21) Appl. No.: 09/954,924

(22) Filed: Sep. 18, 2001

(65) Prior Publication Data

US 2003/0052239 A1 Mar. 20, 2003

(51) Int. Cl.[7] ..... A01K 97/10
(52) U.S. Cl. ..... 248/533; 248/156; 248/121
(58) Field of Search ..... 248/158, 156, 248/121, 122.1, 532, 533, 519, 529, 150, 165; 40/607, 617; 232/38, 39; D99/32; 52/165

(56) References Cited

U.S. PATENT DOCUMENTS

| | | | | | |
|---|---|---|---|---|---|
| D70,163 | S | | 5/1926 | Dobbins | |
| 1,590,725 | A | | 6/1926 | Coates | 232/39 |
| D172,997 | S | | 9/1954 | Stallings | |
| D182,607 | S | | 4/1958 | Loewenstein | |
| D194,895 | S | | 3/1963 | Bardos | |
| D197,683 | S | | 3/1964 | Kusel | |
| D199,107 | S | | 9/1964 | Kusel | |
| D200,748 | S | | 3/1965 | Taylor | D99/32 |
| 3,957,250 | A | | 5/1976 | Murphy | 256/19 |
| D254,755 | S | | 4/1980 | Mortensen et al. | D99/32 |
| 4,327,514 | A | * | 5/1982 | Bourque | 40/607 |
| 4,343,449 | A | * | 8/1982 | Osthus | 248/156 |
| 4,483,506 | A | * | 11/1984 | Litwiller | 248/545 |
| 4,496,123 | A | * | 1/1985 | Laramie | 248/121 |
| 4,509,675 | A | | 4/1985 | Siff et al. | 232/17 |
| 4,588,123 | A | | 5/1986 | Plew | 232/39 |
| 4,602,765 | A | | 7/1986 | Loper et al. | 256/19 |
| D291,937 | S | | 9/1987 | Fisher | D99/30 |
| 4,709,853 | A | | 12/1987 | Hahn | 232/39 |
| 4,790,092 | A | * | 12/1988 | Farmer | 40/607 |
| 4,858,891 | A | | 8/1989 | Boes | 256/19 |
| 5,022,618 | A | | 6/1991 | Barrett et al. | 248/146 |
| 5,119,986 | A | | 6/1992 | Kobilarcik et al. | 232/35 |
| D334,272 | S | | 3/1993 | Gaines | D99/32 |
| D338,762 | S | | 8/1993 | Nichols | D99/32 |
| 5,356,072 | A | | 10/1994 | Thomas | 232/39 |
| D378,462 | S | | 3/1997 | Erwin | D99/32 |
| 5,620,136 | A | | 4/1997 | Erwin | 232/39 |
| 5,806,758 | A | | 9/1998 | Erwin | 232/39 |
| 5,833,181 | A | * | 11/1998 | DesNoyers | 248/156 |
| 5,903,991 | A | * | 5/1999 | Sasse | 40/607 |

* cited by examiner

*Primary Examiner*—Gwendolyn Baxter
(74) *Attorney, Agent, or Firm*—Gardner Groff, P.C.

(57) ABSTRACT

A mailbox post assembly and kit for insertion into the ground and for supporting a mailbox, in which an elongate, hollow post has cooperating openings for transversely receiving a hollow beam, decorative inserts are mounted on the post and beam to give the appearance of a brace, and during transportation or storage, the hollow beam and the decorative inserts fit inside of the hollow post.

19 Claims, 4 Drawing Sheets

MAILBOX POST ASSEMBLY

TECHNICAL FIELD

This invention relates to mailbox post assemblies in general, and in particular to one which is easily assembled and which can be stored compactly in unassembled form.

BACKGROUND OF THE INVENTION

Mailbox post assemblies are used to support mailboxes in front of almost every house. These mailbox post assemblies are typically made from wood, metal or plastic. A typical mailbox post assembly is large, bulky, heavy, somewhat expensive, and prone to rotting. The post is usually made out of a nominally four inch by four inch square length of wood, the bottom of which is sunk into the ground. A similar horizontal wood beam is attached to the post asymmetrically near the top of the post. Often, a diagonal wood brace extends from the post to the beam in order to stiffen the structure. In recent years, similar-looking plastic mailbox post assemblies have been introduced which are lighter, often less expensive, and more resistant to rotting.

However, these typical wood mailbox post assemblies and plastic mailbox post assemblies continue to share common shortcomings. First, if typical mailbox post assemblies are shipped in pre-assembled form, then they are somewhat bulky to ship, bulky to store, and easily damaged during shipment or storage. Second, if typical mailbox post assemblies are shipped in unassembled form, then they are still relatively bulky to ship, bulky to store, and require some separate packaging to carry the fasteners that will be used to join the post and the beam.

Thus, there is an unfulfilled need for a mailbox post assembly which can be assembled easily and which can be stored compactly in unassembled form.

SUMMARY OF THE INVENTION

Briefly described, in a first preferred form the present invention comprises a mailbox post assembly for insertion into the ground and for supporting a mailbox. The mailbox post assembly includes an elongate, hollow post that has a pair of cooperating openings formed therein and positioned generally toward one end of the post. The cooperating openings are positioned on opposite sides of the post from one another. The mailbox post assembly also includes an elongate, transverse beam sized and configured to be received in the cooperating openings of the post for extending therethrough. The beam and the post are both sized and shaped to allow the beam to be fitted within the hollow post in a nested arrangement for transportation prior to installation.

Preferably, the mailbox post assembly also includes at least one decorative element for mounting to the post and/or the beam. The decorative element preferably is sized and configured allow it to be fitted within the hollow post for transportation prior to installation. Preferably, the post and the beam are rectangular. Most preferably, the post and the beam are square. Also, preferably the decorative element comprises two decorative elements which, when mounted, provide the appearance of a supporting brace extending from the underside of the beam to an adjacent side of the upright post. Preferably, the post and the beam have similar cross-sectional shapes, but the external dimensions of the beam are smaller than internal dimensions of the hollow post to allow the beam to be slid within the post in a nested arrangement for shipment and storage prior to sale to a consumer.

In another preferred form, the present invention comprises a mailbox post kit for subsequent assembly and installation. The kit comprises an elongate hollow post having a pair of cooperating openings formed therein positioned generally near one end of the post. The cooperating openings are positioned on opposite sides of the post from one another. An elongate transverse beam is sized and configured to be received in the cooperating openings for extending therethrough. However, in the kit, the beam is fitted within the interior of the hollow post in a nested arrangement for transportation, storage, and sale prior to installation by a user or purchaser.

Preferably, the mailbox post kit includes at least one decorative element for mounting to the post or the beam and also is fitted within the hollow post for transportation, storage, and sale prior to installation.

Preferably, in both the assembly and kit described above, the post and the beam have matching geometric shapes of slightly different sizes to allow one to be slid within the other. For example, they can both be square, rectangular, oval, or circular. Alternatively, they can have different shapes provided that the external dimensions of the beam are smaller than the internal dimensions of the post (or that the external dimensions of the post are smaller than the internal dimensions of the beam) to allow the one to be nestably slid within the interior of the other. As an example, it is possible to provide a square upright post having elliptical opposed openings and a transverse beam which is elliptical and matched in shape to the openings formed in the post.

The mailbox post assembly and the mailbox post kit according to the present invention have the advantage of allowing the unassembled collection of parts to be transported, displayed and shipped very compactly and efficiently. This is so because all of the parts that stick out from the assembled post can be slid into the post for shipment, storage, and sale. This allows the entire package to be stacked extremely efficiently owing to the regular shape of the upright post. In this regard, the post having a rectangular or square shape has a slight advantage over other shapes in that it allows the packaged unassembled parts to be stored very tightly one against another in a store or in a container.

The present invention allows for very compact storage and transportation of the product prior to sale. It also provides a handy, easily-carried package to allow a purchaser or user to easily transport the mailbox post assembly from the store to the installation site.

Accordingly, it is an object of the present invention to provide a mailbox post assembly that can be transported easily and handily by an individual.

It is another object of the present invention to provide a mailbox post assembly that can be compactly stored for shipment.

It is another object of the present invention to provide a mailbox post assembly that can be assembled easily in the field.

It is another object of the present invention to provide a mailbox post assembly that is durable in its construction, simple to manufacture, and economical to manufacture and purchase.

These and other objects, features, and advantages of the present invention will become more apparent upon reading the following specification in conjunction with the accompanying drawing figures.

DETAILED DESCRIPTION OF THE PREFERRED EMBODIMENTS

Figure 6:
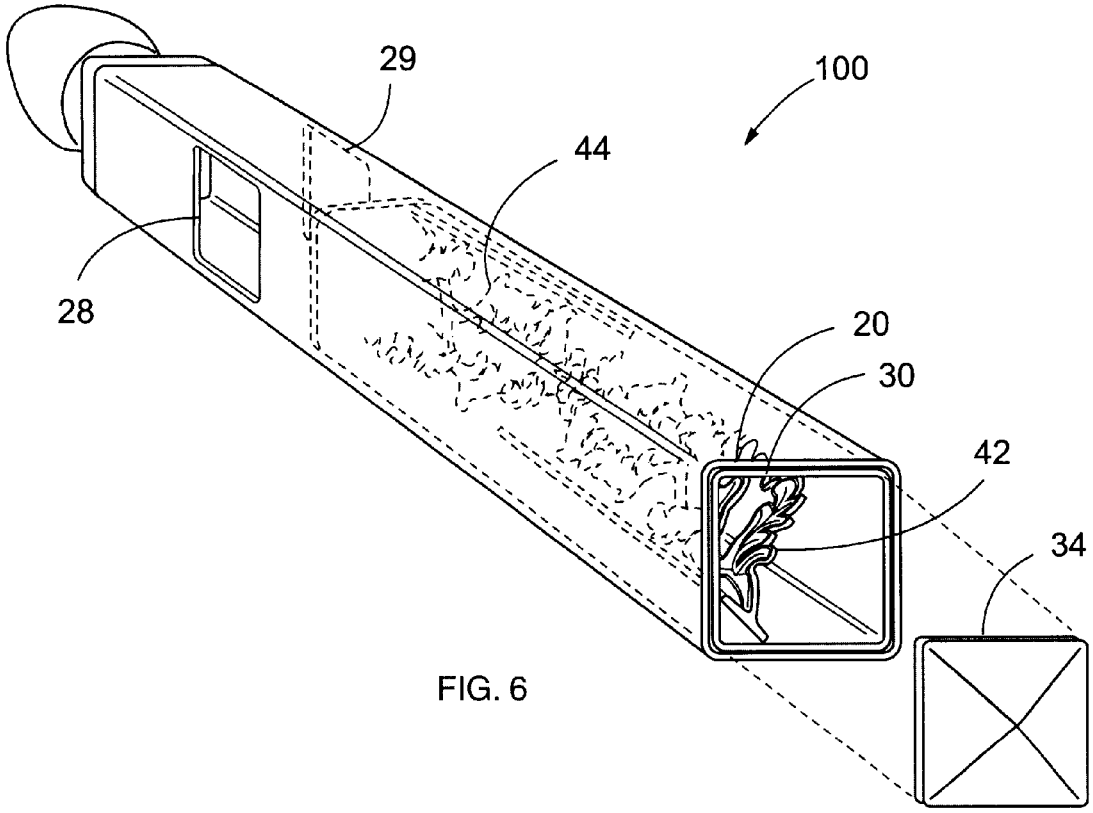
FIG. 6 is a perspective, partially-exploded view of the mailbox post assembly of FIG. 1, with some elements removed for clarity of illustration, and shown as configured for transportation or storage.
Figure 7:
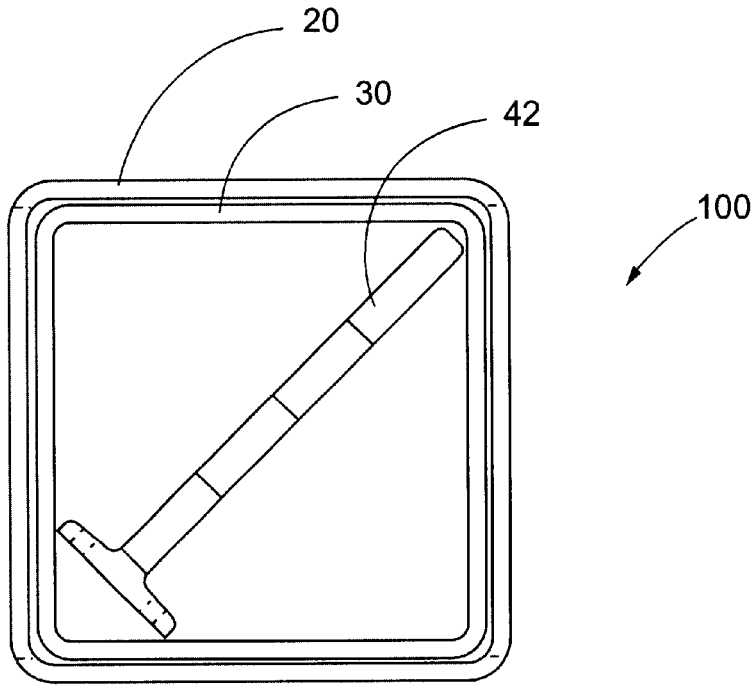
FIG. 7 is a cross-sectional view of the mailbox post assembly of FIG. 6.

Referring now in detail to the drawing figures, wherein like reference numerals represent like parts throughout the several views, FIGS. 1–5 show a mailbox post assembly 10 according to a preferred form of the invention. The mailbox post assembly 10 shown in FIGS. 1–5 is depicted in its assembled state, while FIGS. 6 and 7 depict the unassembled mailbox post (a kit) in a configuration for transportation and storage prior to assembly.

Referring now again to FIGS. 1–5, the mailbox post assembly 10 includes an elongate, upright hollow post 20 and an elongate, lateral transverse beam 30 as its major parts thereof. The mailbox post assembly 10 preferably is made from a weatherable plastic, such as PVC, or other suitable material. Those skilled in the art will recognize that various other materials can be used.

The hollow upright post 20 preferably is dimensioned to mimic the appearance of a traditional wooden post and therefore would have a nominal four inch by four inch square cross-section (actually about 3½ by 3½, but commonly referred to as four by four). However, other shapes and dimensions can be employed. For example, the post 20 can have rectangular cross-section, rather than square-cross section. Also, the post 20 can be circular in cross-section or elliptical. Furthermore, the post 20 can be fluted if desired. The upright post 20 includes an upper end 21 and a lower end 23. Preferably, the post 20 includes a top cap or finial 24 adjacent the upper end 21 to provide a finished look and to keep moisture, insects, dirt, and debris from collecting inside the hollow post 20. The finial, as can be easily understood, can take a variety of shapes.

The transverse beam 30 includes a first end 31 and a second end 33 opposite the first end 31. The ends 31 and 33 are capped with end caps 34 and 36 to provide a finished look and to keep moisture, insects, dirt, and debris from collecting inside the hollow beam 30. As shown, the end caps 34, 36 are beveled. However, those skilled in the art will recognize that other shapes can be employed. An upper surface 32 of the transverse beam 30 preferably is flat and receives a mailbox, which is not shown in the figures for simplicity. The mailbox can take a variety of shapes, sizes and appearances.

Figure 1:
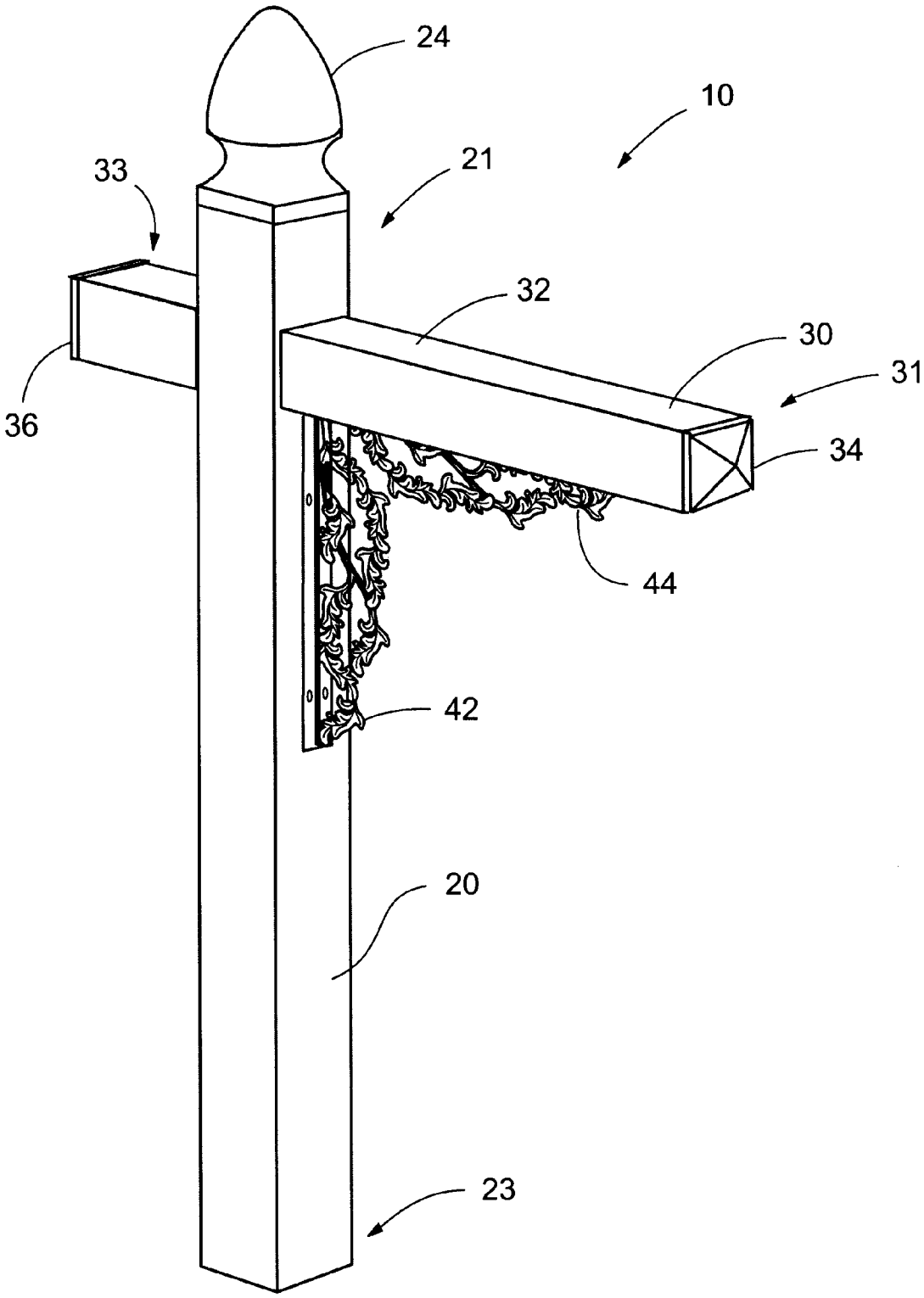
FIG. 1 is a perspective illustration of a mailbox post assembly according to a preferred form of the invention.
Figure 2:
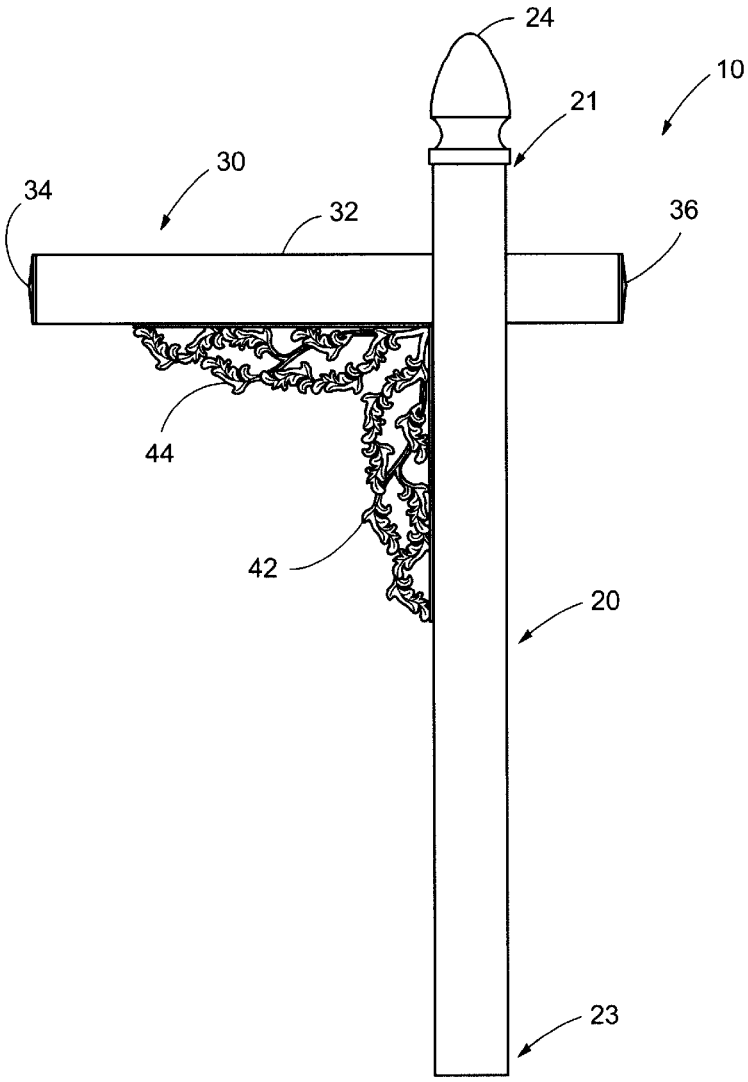
FIG. 2 is a right side elevation view of the mailbox post assembly of FIG. 1.
Figure 3:
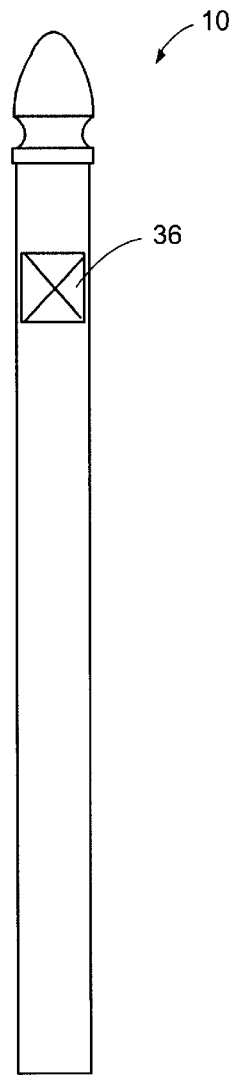
FIG. 3 is a rear elevation view of the mailbox post assembly of FIG. 1.
Figure 4:
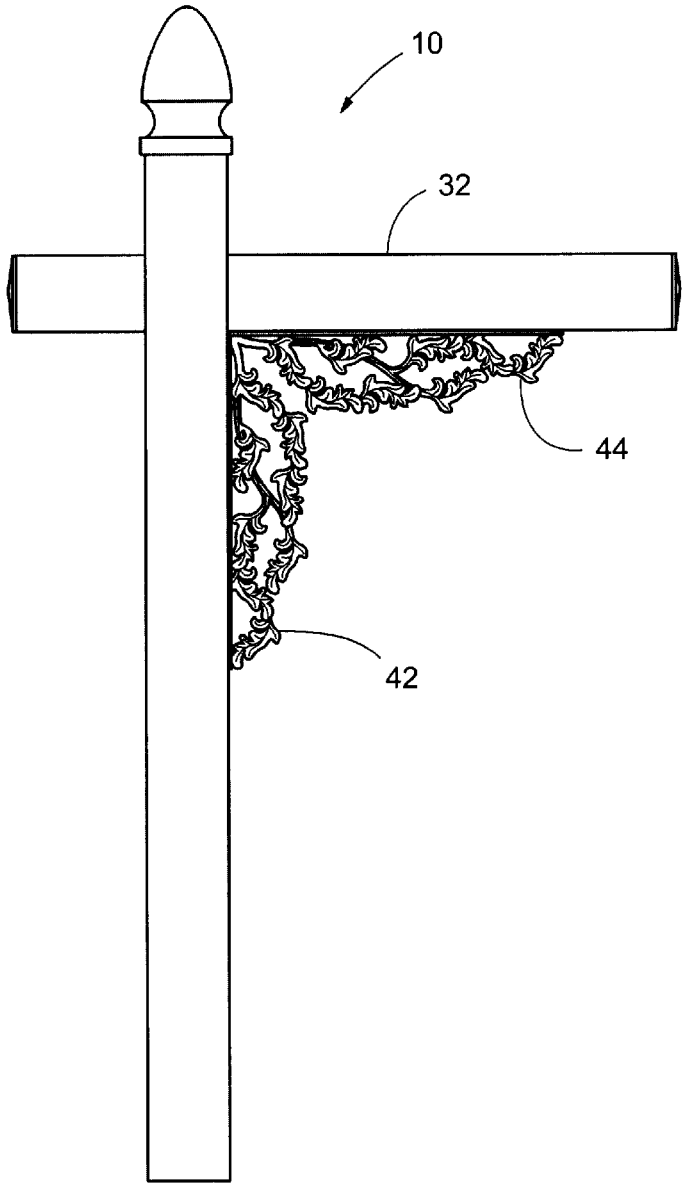
FIG. 4 is a left side elevation view of the mailbox post assembly of FIG. 1.
Figure 5:
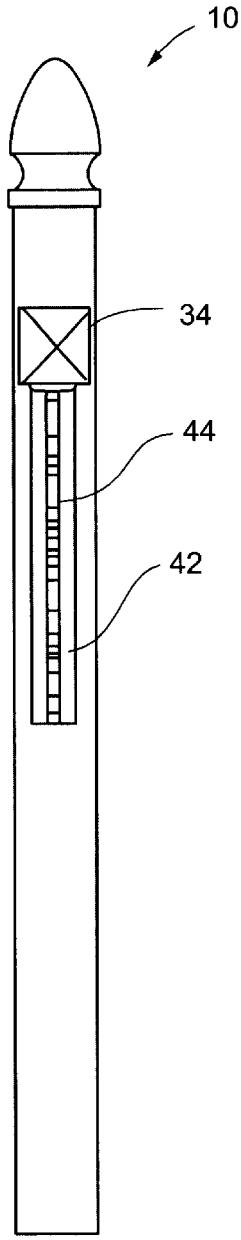
FIG. 5 is a front elevation view of the mailbox post assembly of FIG. 1.

The transverse beam 30, as depicted in FIG. 1, preferably is square in cross-section. As with the upright post 20, those skilled in the art will recognize that other shapes can be employed. However, a most pleasing visual effect is achieved by using matching or corresponding shapes, such as by having the upright post be square and the transverse beam also square. Alternatively, the upright post could be square and the transverse beam could be rectangular, round, or other shapes.

The transverse beam 30 preferably is sized and dimensioned to be slightly smaller in its major dimensions (width and height) than the upright post 20. In this way, the upright post 20 can be provided with openings that are sized to receive the lateral beam therethrough. Alternatively, one could construct the post and beam to have an opposite size relationship in that the post could be made to have the smaller dimensions and the beam could be provided with holes extending therethrough and allowing the post to extend up through the beam. However, this has the disadvantage of requiring additional bracing and/or fastening in order to secure the lateral beam 30 vertically and is not as attractive.

Still referring to FIG. 1, the post assembly preferably includes a lower decorative element 42 secured to a front face of the upright post 20 just beneath the transverse beam 30. A matching decorative element 44 is secured to an underside surface of the transverse beam 30 near the upright post 20. Preferably, the decorative elements 42 and 44 are designed to cooperatively provide the appearance of a unitary brace or strut extending between the underside of the transverse beam 30 and the front face of the upright post 20. Most preferably, the decorative elements 42 and 44 are identical to one another. Decorative elements 42 and 44 can be secured in place by adhesives, plastic, welding, clamps, screws, etc. Preferably, the means for attachment is visually unobtrusive. As will be explained in greater detail in connection with FIGS. 6 and 7, the decorative elements 42 and 44 are sized to be received within the interior of the transverse beam 30 when the unassembled elements are configured for shipping and storage prior to assembly.

Referring now to FIGS. 6 and 7, the post assembly is shown in its unassembled or kit form, in which it is compactly configured for transportation or storage prior to assembly. The hollow design of transverse beam 30 and the hollow post 20 allow all of the elements to fit inside of each other in a compact shipping configuration that minimizes overall volume and reduces the chance of damage to any elements. Also, this compact shipping configuration requires little or no additional packaging beyond shrink-wrapped cellophane. Additionally, the preferred square cross-section of the beam 30 and the post 20 yield a square cross-section shipping configuration where the relatively thin wall of the beam 30 and the relatively thin wall of the post 20 are combined to effectively form a strong double wall protection for the decorative elements during shipping.

Examining FIG. 6 in detail, this is a perspective, partially-exploded view of a kit 100 for assembly into the mailbox post assembly 10 of FIG. 1, with some elements removed for clarity of illustration, and shown as configured for transportation or storage. FIG. 6 shows an opening 28 in the post 20 and a cooperating opening 29 on the opposite side of the post 20. When assembled (as shown in FIG. 1), the beam 30 extends through these cooperating openings 28 and 29.

Still referring to FIG. 6, the kit 100 is shown to include the beam 30 and the post 20 with square cross-sections. In this compact configuration, the decorative elements 42 and 44 are shown tightly nested diagonally inside of the hollow transverse beam 30. Similarly, the beam 30 is tightly nested snugly inside the hollow post 20. For clarity, the end cap 34 of the beam 30 is shown spaced apart from the beam 30 and the post 20.

Further examining FIG. 6, those skilled in the art will recognize that this end cap 34, can also fit diagonally within beam 30. Additional elements that are not shown will also fit within the beam 30. These additional elements include the other end cap 36 (not shown in this figure), and any fasteners (not shown) for fastening the decorative elements 42 and 44 to the post 20 and the beam 30. Preferably, any related printed documentation, such as instructions for assembly and a warranty, will also be placed inside of beam 30. Alternately, the end caps 34 and 36 could be mounted on the two ends of beam 30, thus holding loose elements (decorative elements 42 and 44, fasteners, and printed documents) within the beam.

Those skilled in the art will recognize that other similar compact configurations can be provided. For example, a rectangular cross-section beam inside a rectangular cross-section post, or a circular beam inside a circular post. Alternately, the internal dimensions of the beam could be larger than the external dimensions of the post, and the post could be compactly configured within the beam in such a way as to protect the decorative finial 24.

FIG. 7 is a cross-sectional view of the mailbox post kit 100 in the compact transportation configuration of FIG. 6. This cross-sectional view clearly shows the decorative element 42 diagonally nested within the beam 30, which is in turn nested within post 20.

Continuing describing FIG. 7, those skilled in the art will immediately recognize the many advantages of this compact configuration of the post kit 100. First, the overall volume is minimized, which reduces transportation and storage costs. Second, the tight internal fit of the elements means that little or no additional packaging materials will be required. Using little or no additional packaging materials reduces the overall material costs, as well as reducing transportation costs by reducing weight. Third, the tight internal fit of the elements adds structural strength. For example, the tight fit of the beam 30 inside of the post 20 effectively gives double wall protection to the decorative element 42. Also, this double wall effect allows the beam 30 wall to help keep the post 20 wall protected somewhat. Fourth, the compact configuration is easy to carry during transportation. The compact configuration also is easy to stack for storage and display. Moreover, the compact configuration is convenient for the customer to handle during purchase, and to transport in a small vehicle.

While the invention has been disclosed in preferred forms, those skilled in the art will recognize that other shapes can be used that are similarly pleasing to the eye in final assembled form, while retaining all or most of the advantages of the square cross-section shape chosen for the preferred form of the invention. Those skilled in the art will recognize further that many modifications, additions, and deletions can be made therein without departing from the spirit and scope of the invention as set forth in the following claims.

I claim:

1. A mailbox post assembly comprising:

an elongate, hollow post having a pair of cooperating openings formed therein positioned generally nearer one end of said post than another end of said post, said cooperating openings being positioned on opposite sides of said post from one another;

an elongate transverse beam sized and configured to be received in said cooperating openings of said post for extending through said post transversely thereto in use; and at least one first decorative element for mounting solely to said post and at least one second decorative element for mounting solely to said beam, wherein said at feast one first and second decorative elements, when mounted, have the appearance of a brace extending from said beam to said post, wherein said beam and said post are sized and shaped to allow said beam to be fitted within said hollow post in a parallel nested arrangement for transportation prior to installation, and said decorative element is sized and configured to be fitted inside said hollow post for transportation prior to assembly and installation.

2. The mailbox post assembly as claimed in claim 1, wherein said post has a rectangular cross section.

3. The mailbox post assembly as claimed in claim 2, wherein said post has a square cross section.

4. The mailbox post assembly as claimed in claim 1, wherein said post and said beam have similar cross-sectional shapes, but external dimensions of said beam are smaller than the internal dimensions of said post to allow said beam to be nested within said post for shipment and storage.

5. The mailbox post assembly as claimed in claim 4, wherein said post and said beam both have rectangular cross sections.

6. The mailbox post assembly as claimed in claim 5, wherein said post and said beam both have square cross sections.

7. A mailbox post kit for subsequent assembly and installation, said kit comprising:

an elongate, hollow post having a pair of cooperating openings formed therein positioned generally nearer one end of said post than another end of said post, said cooperating openings being positioned on opposite sides of said post from one another; and an elongate hollow transverse beam positioned relative to said hollow post in a tightly nested arrangement for transportation and storage prior to assembly and installation, and sized and configured to be received in said cooperating openings of said post and extended through said post transversely thereto when assembled for use.

8. The mailbox post kit as claimed in claim 7, wherein said post has a rectangular cross section.

9. The mailbox post kit as claimed in claim 8 wherein said post has a square cross section.

10. The mailbox post kit as claimed in claim 7 further comprising at least one decorative element positioned within said hollow beam and said hollow post for transportation and storage prior to assembly and installation, said decorative element being sized and configured for mounting to said post, said beam, or both, and which, when mounted, provides the appearance of a brace.

11. The mailbox post kit as claimed in claim 10 wherein said at least one decorative element comprises two decorative elements with a first one of said decorative elements sized and configured for mounting solely to said post and a second one of said decorative elements sized and configured for mounting solely to said beam, both of which, when mounted, provide the appearance of the brace extending from said beam to said post.

12. The mailbox post assembly as claimed in claim 10, wherein external dimensions of said decorative elements are slightly smaller than internal dimensions of said beam or said post to allow said decorative elements to be tightly nested within said beam and said post for shipment and storage.

13. The mailbox post kit as claimed in claim 7 wherein said post and said beam have similar cross-sectional shapes, but external dimensions of one of said beam or said post are slightly smaller than internal dimensions of the other one of said beam or said post to allow said beam and said post to be tightly nested together to form a closely spaced double wall for structural strength during shipment and storage.

14. The mailbox post kit as claimed in claim 7 wherein when said beam and said post are positioned in said nested position, said beam does not extend from said post.

15. A mailbox post kit for subsequent assembly and installation, said kit comprising:

an elongate, hollow post having a pair of cooperating openings formed therein positioned generally nearer one end of said post than another end of said post, said cooperating openings being positioned on opposite sides of said post from one another;

an elongate hollow transverse beam positioned relative to said hollow post in a nested arrangement for transportation and storage prior to assembly and installation, and sized and configured to be received in said cooperating openings of said post and extended through said post transversely thereto when assembled for use; and at least two decorative elements positioned within said hollow beam and said hollow post for transportation and storage prior to assembly and installation, a first one of said decorative elements sized and configured for mounting to said post and a second one of said decorative elements sized and configured for mounting to said beam, and both of which, when mounted to either a top or a bottom side of said beam for use, provide the appearance of a brace extending from said beam to said post.

16. The mailbox post kit as claimed in claim 15 wherein said post has a rectangular cross section.

17. The mailbox post kit as claimed in claim 15 wherein said post has a square cross section.

18. The mailbox post kit as claimed in claim 15 wherein said post and said beam have similar cross-sectional shapes, but external dimensions of one of said beam or said post are slightly smaller than internal dimensions of the other one of said beam or said post to allow said beam and said post to be tightly nested together to form a closely spaced double wall for structural strength during shipment and storage.

19. The mailbox post kit as claimed in claim 15 wherein said first one of said decorative elements is sized and configured for mounting solely to said post and said second one of said decorative elements is sized and configured for mounting solely to said beam.

* * * * *